US012264465B1

(12) United States Patent
Chen

(10) Patent No.: US 12,264,465 B1
(45) Date of Patent: Apr. 1, 2025

(54) FAUCET FIXING MECHANISM AND FAUCET COMPONENT

(71) Applicant: Yun Chen, Ruian (CN)

(72) Inventor: Yun Chen, Ruian (CN)

( * ) Notice: Subject to any disclaimer, the term of this patent is extended or adjusted under 35 U.S.C. 154(b) by 0 days.

(21) Appl. No.: 18/963,640

(22) Filed: Nov. 28, 2024

(30) Foreign Application Priority Data

Nov. 4, 2024 (CN) ..... 202422675563.2

(51) Int. Cl.
*E03C 1/04* (2006.01)

(52) U.S. Cl.
CPC ..... *E03C 1/0402* (2013.01)

(58) Field of Classification Search
CPC ..... E03C 1/0401; E03C 1/0402; F16B 39/028
See application file for complete search history.

(56) References Cited

U.S. PATENT DOCUMENTS

| | | | | |
|---|---|---|---|---|
| 8,231,318 | B2 * | 7/2012 | Pitsch | F16B 37/0864 411/270 |
| 9,222,245 | B2 * | 12/2015 | Ye | E03C 1/04 |
| 9,637,893 | B2 * | 5/2017 | Lin | E03C 1/0401 |
| 9,932,726 | B2 * | 4/2018 | Song | E03C 1/0402 |
| 2006/0193712 | A1 * | 8/2006 | Kuna | E03C 1/0403 411/340 |

* cited by examiner

*Primary Examiner* — Erin Deery
(74) *Attorney, Agent, or Firm* — Birchwood IP

(57) ABSTRACT

A faucet fixing mechanism and a faucet kit are provided. The faucet fixing mechanism is configured for fixing a faucet on a countertop; and the faucet fixing mechanism includes a threaded tube configured to be inserted into a pre-installed hole on the countertop, a side wall of the threaded tube is provided with an opening hole; a movable slider provided in the threaded tube and clamped onto the opening hole. Without external force, the movable slider is received in the threaded tube to ensure that an outer diameter of the threaded tube is smaller than the pre-installed hole. When the push rod is inserted into the threaded tube and abuts against the movable slider, the movable slider is expanded and moved along a sliding groove on the push rod, rendering the outer diameter of the movable slider larger than a diameter of the pre-installed hole the faucet.

10 Claims, 3 Drawing Sheets

FAUCET FIXING MECHANISM AND FAUCET COMPONENT

CROSS-REFERENCE TO RELATED APPLICATIONS

The application claims priority to Chinese Patent Application No. 202422675563.2, filed on Nov. 4, 2024 which is hereby incorporated by reference in its entirety.

TECHNICAL FIELD

The present disclosure relates to the field of faucet technologies, and in particular, to a faucet fixing mechanism and a faucet kit.

BACKGROUND

At present, a locking fastener for a faucet is located below a countertop. As the faucet is usually installed on one side away from an operating edge, the size of the countertop significantly affects the installation of the faucet. It is necessary to manually drill below the countertop to tighten the faucet fastener, which is inconvenient to operate.

SUMMARY

The purpose of the present disclosure is to provide a faucet fixing mechanism and a faucet kit that can be directly operated above a countertop, which is convenient and fast, in response to defects and deficiencies of the existing technology.

To solve the above technical problems, the present disclosure provides a faucet fixing mechanism for fixing a faucet on a countertop; where the faucet fixing mechanism includes:

- a push rod, configured to be inserted into the countertop, an outer wall of the push rod is provided with an installation groove, and the installation groove is configured to be partially extended into the countertop;
- a threaded tube, configured to be inserted into a pre-installed hole of the countertop, a side wall of the threaded tube is provided with an opening hole;
- a movable slider, provided in the threaded tube and clamped to the opening hole, the movable slider is accommodated in the threaded tube without external force; when the push rod is moved down and inserted into the threaded tube, the movable slider is provided in the installation groove, the movable slider is moved along the installation groove, and the movable slider is extended out of the opening hole and beyond an outer surface of the threaded tube, the threaded tube is caused to hook onto a lower surface of the countertop through an extending part of the movable slider;
- a fastener, provided on an upper surface of the countertop, the fastener and the movable slider are respectively abutted against the upper surface and the lower surface, respectively, of the countertop so as to fix the faucet fixing mechanism to the countertop.

In some embodiments of the present disclosure, the installation groove is arranged along an axis direction of the push rod, the installation groove is at least two installation grooves; the at least two installation grooves are evenly distributed along an outer circumference direction of the push rod;

the movable slider is provided in the installation grooves, the opening hole on the threaded tube is at least two opening boles and the at least two opening holes are corresponded one-to-one with the installation grooves.

In some embodiments of the present disclosure, threads of the threaded tube are external threads, and the fastener is screwed to the outer side of the threaded tube.

In some embodiments of the present disclosure, the fastener is a nut, and a cover is provided on one side of the nut facing the countertop.

In some embodiments of the present disclosure, a depth of the installation groove located in the countertop and along a direction away from the countertop increases.

To solve the above technical problems, the present application further provides a faucet kit, where the faucet kit includes a faucet and the faucet fixing mechanism.

Compared with existing technologies, the beneficial effect of the present disclosure is to fix a fastener and a threaded tube on an outside of a countertop, and render the fastener and a movable slider are respectively abutted against inner and an upper surface of the countertop, so that the entire faucet fixing mechanism can be fixed to the countertop on the outside of the countertop. At this time, only a push rod needs to be pulled out from the outside of the countertop, and the faucet can be fixed in the threaded tube, which can achieve the installation of the faucet on the countertop. This solution can reduce the installation difficulty of the faucet.

DESCRIPTION OF EMBODIMENTS

The following will provide a clear and complete description of the technical solution in the embodiments of the present application, combined with the accompanying drawings. Obviously, the described embodiments are only a part of the embodiments of the present application, not all of them. Based on the embodiments in the present application, all other embodiments obtained by those skilled in the art without creative work are within the protection scope of the present application.

Terms "first", "second", and "third" used in the present application are for a descriptive purpose only and should not be understood as indicating or implying relative importance or implying the number of technical features indicated. Therefore, features referred to "first", "second", and "third" may explicitly or implicitly include at least one of these features. In the description of the present application, the meaning of "multiple" refers to at least two, such as two, three, etc., unless otherwise specified. All directional indications (such as up, down, left, right, front, back, etc.) in the embodiments of the present application are only used to explain a relative position relationship and motion of each component in a specific posture (as shown in the attached drawings). If the specific posture is changed, the directional indication will also be changed accordingly. Furthermore, the terms "including" and "comprising", as well as any variations thereof, are intended to cover a non-exclusive inclusion. For example, a process, method, system, product, or device that includes a series of steps or units is not limited to the listed steps or units, but may optionally include steps or units that are not listed, or may optionally include other steps or units that are inherent to these processes, methods, products, or devices.

Referring to "embodiments" in this specification means that specific features, structures, or characteristics described in combination with the embodiments may be included in at least one embodiment of the present application. The phrase appearing in various positions in the specification does not necessarily refer to the same embodiment, nor is it an independent or alternative embodiment that is mutually exclusive with other embodiments. Those skilled in the art explicitly and implicitly understand that the embodiments described in this specification can be combined with other embodiments.

Below, a detailed explanation of the present application will be provided in combination with the accompanying drawings and embodiments.

Figure 1:
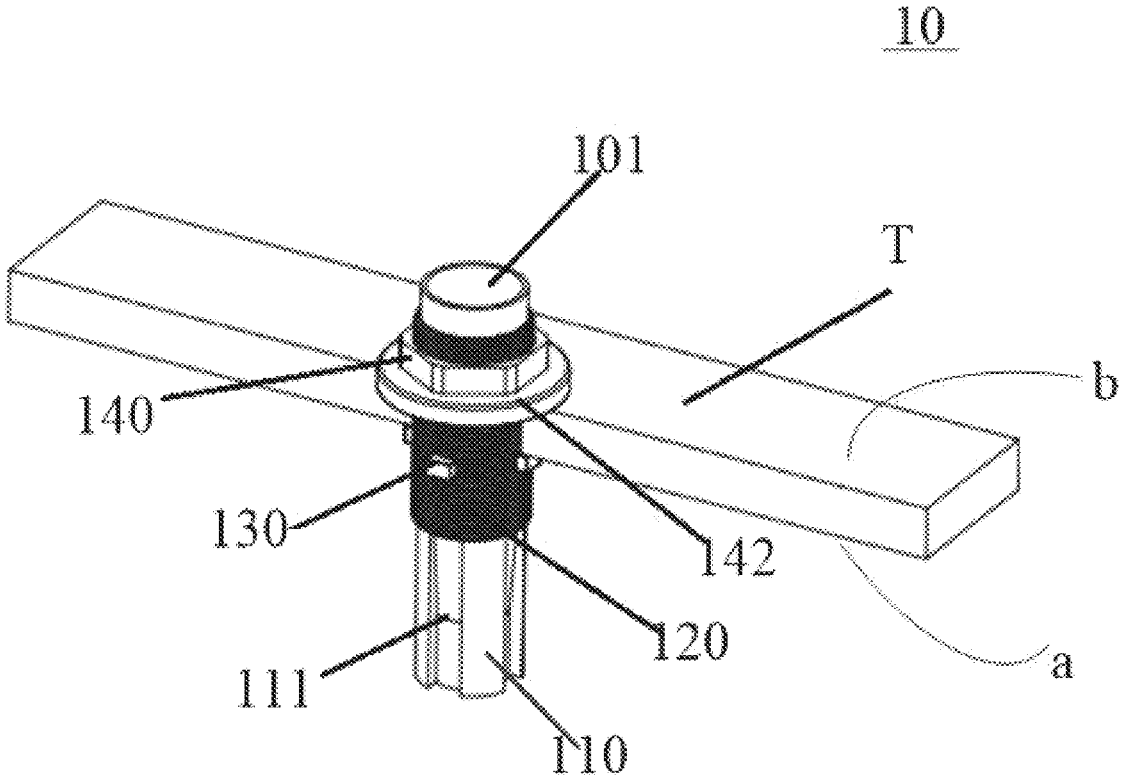
FIG. 1 is a schematic structural diagram of a faucet fixing mechanism in an embodiment provided in the present application.
Figure 2:
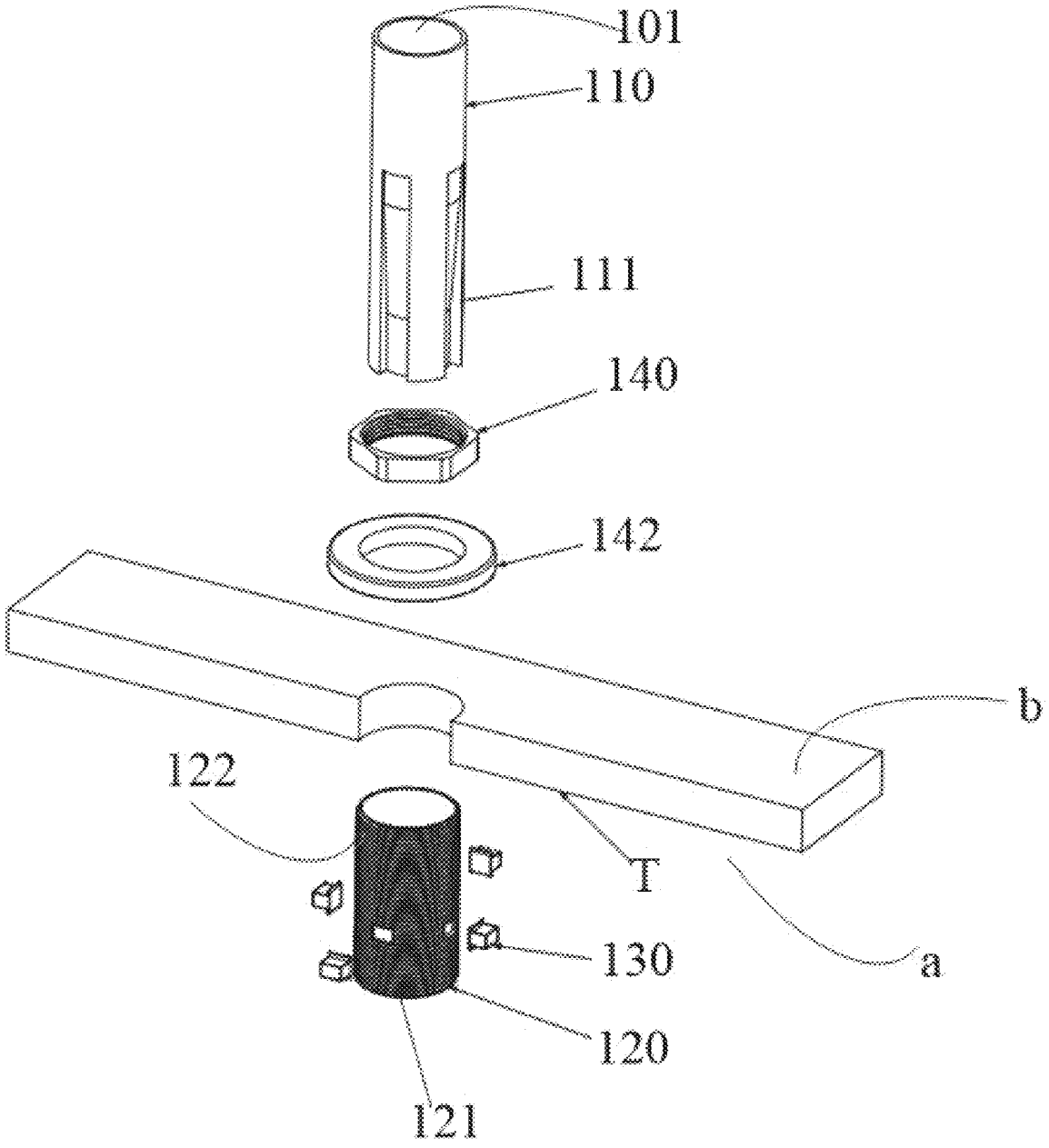
FIG. 2 is an exploded view of the faucet fixing mechanism shown in FIG. 1.
Figure 3:
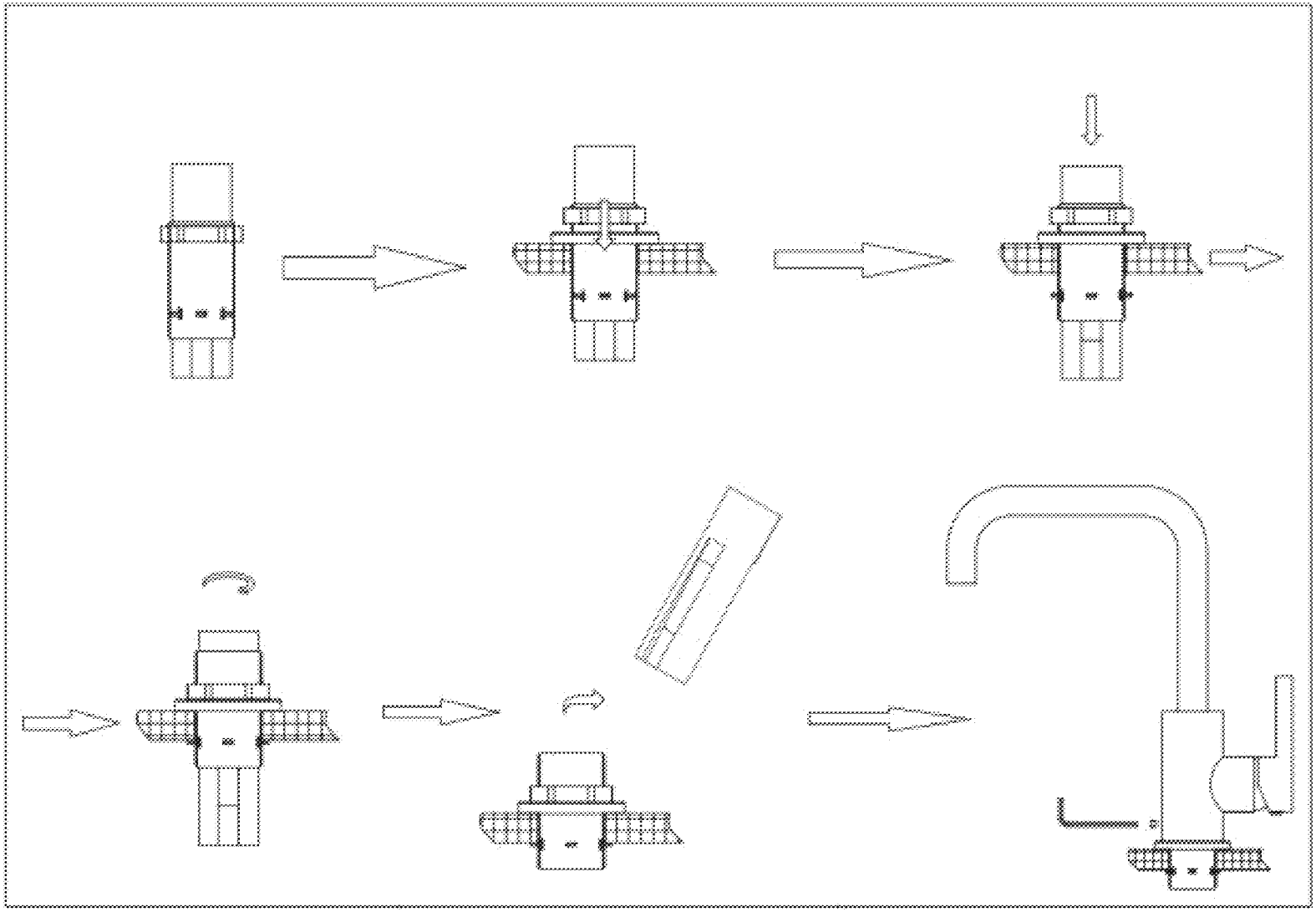
FIG. 3 is a schematic diagram of a process of fixing a faucet with the faucet fixing mechanism shown in FIG. 1.

Please refer to FIGS. 1-3. Where, FIG. 1 is a structural schematic diagram of a faucet fixing mechanism in an embodiment provided in the present application. FIG. 2 is an exploded view of the faucet fixing mechanism shown in FIG. 1. FIG. 3 is a schematic diagram of a process of fixing a faucet with the faucet fixing mechanism shown in FIG. 1.

Where, the faucet fixing mechanism 10 is configured for fixing a faucet on a countertop T. The faucet fixing mechanism 10 includes a push rod 110, a tooth tube 120, a movable slider 130, and a fastener 140.

The threaded tube 120 is sleeved on the push rod 110, and a component formed by the threaded tube 120 and the push rod 110 can be inserted into the countertop T.

Where, an outer wall of the push rod 110 is provided with an installation groove 111, the installation groove 111 is configured to be partially extended into the countertop T; and the threaded tube 120 partially covers a part area of the installation groove 111; the threaded tube 120 is provided with an opening hole 121; the movable slider 130 is provided in the installation groove 111 and is located at an inner side a of the countertop T. The movable slider 130 is at least partially inserted into the opening hole 121 so as to fix the push rod 110 and the tooth tube 120; the fastner 140 is provided on an upper surface b of the countertop T; the fastener 140 and the movable slider 130 are respectively abutted against the upper surface and the lower surface, respectively, of the countertop T so as to fix the faucet fixing mechanism 10 to the countertop.

Therefore, in this embodiment, the fastener 140 and the threaded tube 120 are fixed on the upper surface b of the countertop T; the fastener 140 and the movable slider 130 are respectively abutted against the inner side a and the upper surface b of the countertop T. This can achieve the fixing of the entire faucet fixing mechanism 10 to the countertop T on the upper surface b. At this time, the push rod 110 is only needed to be pulled out from the upper surface b of the countertop T, and the faucet can be fixed in the threaded tube 120, which can achieve the installation of the faucet on the countertop T. This solution can reduce the installation difficulty of the faucet.

Please further refer to FIGS. 1 and 2.

In this embodiment, the installation groove 111 is arranged along an axis direction of the push rod 110, and the installation groove 111 is at least two installation grooves. The at least two installation grooves 111 are evenly distributed along an outer circumference direction of the push rod 110. The movable sliders 130 are provided in the installation grooves 111, the opening hole 121 on the threaded tube 120 is at least two opening holes and the at least two opening holes 121 are corresponded one-to-one with the installation grooves 111.

In this embodiment, a depth of the installation groove 111 located in a bottom area of the push rod 110 can be configured to be no less than a height of the movable slider 130. The movable slider 130 can be first placed in an area of a bottom side of the push rod 110 in the installation groove 111, and then the tooth tube 120 is sleeved on the installation groove 111 to render the movable slider 130 to be corresponded one-to-one with the opening hole 121. By pulling the tooth tube 120 upwards, the movable slider 130 can be driven to move upwards along the installation groove 111. As the depth of the installation groove 111 decreases upwards, the movable slider 130 can be extended out of the opening hole 121 and be exposed, and finally clamp the tooth tube 120 and the push rod 110 tightly. At this time, the push rod 110 cannot continue to move towards the inner side a of the countertop T under a clamp of the movable slider 130. However, due to a gradual change in the depth of the installation groove 111, the push rod 110 can be pulled out as a whole from the upper surface b of the countertop T.

In this embodiment, by further pulling the tooth tube 120 upwards, a part of the movable slider 130 extending from the opening hole 121 can installation abut against a surface of the countertop T located on its inner side a. Then, by pressing the fastener 140 against the surface of the countertop T located on its upper surface b and fixing the fastener 140 to the tooth tube 120, the entire faucet fixing mechanism 10 can be fixed to the countertop T.

In an implementation mode, threads of the threaded tube 120 are external threads 122, and the fastener 140 is screwed to the outer side of the threaded tube 120. By rotating the threaded tube 120, the fastener 140 and the movable slider 130 can be respectively abutted against the upper surface and the lower surface, respectively, of the countertop T so as to fix the faucet fixing mechanism 10 to the countertop.

Where, the fastener 140 is a nut, and a cover 142 is provided on one side of the nut facing the countertop T. In an implementation mode, the fastener 140 may also be a pin, dowel, or other fastener.

Based on the same inventive concept, the present disclosure further provides a faucet kit, which includes a faucet and the faucet fixing mechanism 10 as described earlier.

Please refer to FIG. 3 for the installation process of the faucet.

Firstly, the movable slider 130 is embedded as a whole in the threaded tube 120. In this state, the fastener 140 can be rotated to move the threaded tube 120 upwards. The push rod 110 can cause the movable slider 130 to slide along the installation groove 111. Due to the depth change of the installation groove 111, when the movable slider 130 is slid along the installation groove 111, it can push movable slider 130 out of the opening hole 121, causing a final size of the movable slider 130 to exceed a through hole of the threaded tube 120 corresponding to the countertop T; by further rotating the fastener 140, the fastener 140 and the movable slider 130 can be finally abutted against the upper surface and the lower surface, respectively of the countertop T, and the threaded tube 120 can be fixed. Then, the push rod 110 can be pulled out, and the faucet can be fixedly installed in the threaded tube 120.

In summary, the present disclosure provides a faucet fixing mechanism and a faucet kit, where the faucet fixing mechanism provided by the present disclosure fixes the fastener and the tooth tube on the upper surface of the countertop, and causes the fastener and the movable slider to respectively abut against inner and the upper surface of the countertop, so that the entire faucet fixing mechanism can be fixed to the countertop on the upper surface of the countertop. At this time, the faucet is simply fixed in a middle channel of the push rod, and the faucet can be installed on the countertop. This solution can reduce the difficulty of installing the faucet without drilling down to the countertop for operation, rendering the installation to be convenient and fast.

For those skilled in the art, they can modify the technical solutions described in the embodiments and replace some technical features equally. Any modifications, equivalent replacements, improvements, etc. made within the spirit and principles of the present disclosure should be included in the protection scope of the present disclosure.

What is claimed is:

1. A faucet fixing mechanism for fixing a faucet on a countertop; wherein the faucet fixing mechanism comprises:

a push rod, configured to be inserted into the countertop, an outer wall of the push rod is provided with an installation groove, and the installation groove is configured to be partially extended into the countertop;

a threaded tube, configured to be inserted into a pre-installed hole of the countertop, a side wall of the threaded tube is provided with an opening hole;

a movable slider, provided in the threaded tube and clamped to the opening hole, the movable slider is accommodated in the threaded tube without external force; when the push rod is moved down and inserted into the threaded tube, the movable slider is provided in the installation groove, the movable slider is moved along the installation groove, and the movable slider is extended out of the opening hole and beyond an outer surface of the threaded tube, the threaded tube is caused to hook onto a lower surface of the countertop through an extending part of the movable slider;

a fastener, provided on an upper surface of the countertop, the fastener and the movable slider are respectively abutted against the upper surface and the lower surface, respectively, of the countertop so as to fix the faucet fixing mechanism to the countertop.

2. The faucet fixing mechanism according to claim 1, wherein the installation groove is arranged along an axis direction of the push rod, wherein the installation groove is at least two installation grooves; the at least two installation grooves are evenly distributed along an outer circumference direction of the push rod;

the movable slider is provided in the installation grooves, the opening hole on the threaded tube is at least two opening holes and the at least two opening holes are corresponded one-to-one with the installation grooves.

3. A faucet kit, wherein the faucet kit comprises a faucet and the faucet fixing mechanism according to claim 2.

4. The faucet fixing mechanism according to claim 1, wherein threads of the threaded tube are external threads, and the fastener is screwed to the threaded tube.

5. The faucet fixing mechanism according to claim 4, wherein the fastener is a nut, and a cover is provided on one side of the nut facing the countertop.

6. A faucet kit, wherein the faucet kit comprises a faucet and the faucet fixing mechanism according to claim 5.

7. A faucet kit, wherein the faucet kit comprises a faucet and the faucet fixing mechanism according to claim 4.

8. The faucet fixing mechanism according to claim 1, wherein a depth of the installation groove located in the countertop and along a direction away from the countertop increases.

9. A faucet kit, wherein the faucet kit comprises a faucet and the faucet fixing mechanism according to claim 4.

10. A faucet kit, wherein the faucet kit comprises a faucet and the faucet fixing mechanism according to claim 1.

* * * * *